United States Patent [19]

Kanoto

[11] 4,334,946

[45] Jun. 15, 1982

[54] PAPER SPLICER WITH UPSTREAM SPLICING TABLE

[75] Inventor: Masanobu Kanoto, Tokyo, Japan

[73] Assignee: Canon Kabushiki Kaisha, Tokyo, Japan

[21] Appl. No.: 194,989

[22] Filed: Oct. 8, 1980

[30] Foreign Application Priority Data

Oct. 16, 1979 [JP] Japan ..... 54-133104

[51] Int. Cl.[3] ..... B25B 31/00

[52] U.S. Cl. ..... 156/352; 156/304.1; 156/304.2; 156/361; 156/362; 156/384; 156/388; 156/505; 156/507

[58] Field of Search ..... 156/304.1, 304.2, 352, 156/361, 362, 384, 388, 505, 507

[56] References Cited

PUBLICATIONS

"Paper Path of an On-Line Computer-Output Printer", Svendsen, R. G., IBM J. Res. Develop., vol. 22, No. 1, Jan. 1978, pp. 13-18.

*Primary Examiner*—Marion McCamish

*Attorney, Agent, or Firm*—Fitzpatrick, Cella, Harper & Scinto

[57] ABSTRACT

A paper splicer incorporated in a line printer of a construction, wherein paper having a series of engaging holes formed at both sides thereof is forwarded in one direction. The splicer has a paper end position detector, a paper splicing table, and a tractor having a plurality of pins to be engaged with the engaging the holes of the paper, which are arranged sequentially in contact with the lower surface of the paper. With this arrangement, a position where the last end of the paper arrives is detected by the paper end position detector, and, at the same time, the last end of the paper is stopped on the upper surface of the splicing table, and the engaging holes of the subsequent paper are engaged with the pins on the tractor, and the last end of the paper is spliced, on the splicing table, with the subsequent paper by means of an adhesive tape.

3 Claims, 7 Drawing Figures

PAPER SPLICER WITH UPSTREAM SPLICING TABLE

BACKGROUND OF THE INVENTION

1. Field of the Invention

This invention relates to a paper splicer incorporated in an information recording apparatus to be used in the field of information processing technology such as, for example, line printers represented by a laser beam printer, a type drum line printer, and so on.

2. Description of the Prior Arts

The laser beam printer has been developed in answer to demands for high speed processing of informations. It has a printing speed of 6,000 to 10,000 lines per minute and is capable of printing a carton of standard format paper in about 30 minutes.

On the other hand, however, the printer has such a disadvantage that, at present, it requires three to four minutes for splicing the last end of the preceding paper and the forward end of the subsequently supplied paper, hence the splicing time is fairly long in comparison with the printing speed and the efficiency in use of the high speed printer should inevitably lower.

SUMMARY OF THE INVENTION

It is therefore a primary object of the present invention to provide a paper splicer capable of reducing the splicing time in the high speed printer.

According to the present invention, in general aspect thereof, there is provided a paper splicer incorporated in a line printer of a construction, wherein paper having a series of engaging holes formed at both sides thereof is forwarded in one direction, the splicer being so constructed that a paper end position detector, a paper splicing table, and a tractor having a plurality of pins to be engaged with the engaging holes of the paper are sequentially arranged in contact with the lower surface of the paper, with which arrangement a position where the last end of the paper arrives is detected by the paper end position detector, and, at the same time, the last end of the paper is stopped on the upper surface of the splicing table, and the engaging holes of the subsequent paper are engaged with the pins on the tractor, and the last end of the paper is spliced with the forward end of the newly supplied paper with an adhesive tape on the splicing table.

As stated in the foregoing, according to the present invention, since the engaging holes formed at both sides of the paper are engaged with the pins of the tractor to set position of the preceding paper and the subsequent paper, the positioning of the papers in their lengthwise and breadthwise directions can be done precisely, hence there is no necessity for providing separate positioning pins, and the splicing work can be done easily, which contributes to improvement in the utility of the high speed printer.

DESCRIPTION OF THE PREFERRED EMBODIMENT

Figure 1:
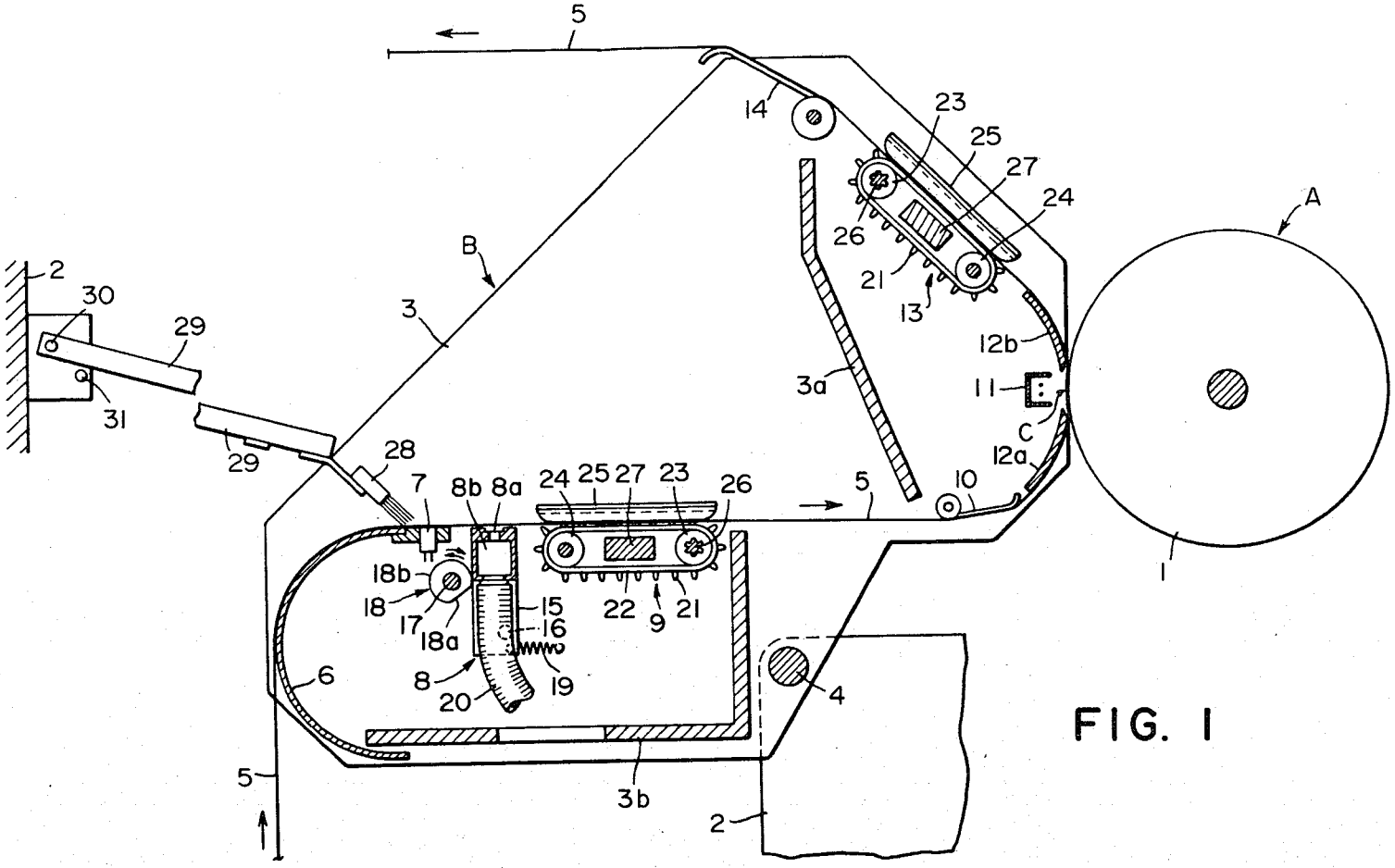
FIG. 1 is a side elevational view, in cross-section, of one preferred embodiment of the paper splicer according to the present invention.

FIG. 1 shows a state of paper conveyance, wherein a reference letter A designates a printing mechanism, and B refers to a paper conveying device provided with the paper splicer according to the present invention.

The printing mechanism A has a photosensitive drum 1 with a photosensitive member being provided on the outer peripheral surface thereof and electrophotographic processing instruments (not shown) disposed around the photosensitive drum. An electrostatic latent image is formed on the surface of the photosensitive member of the photosensitive drum 1 by exposing a laser beam which has been subjected to light-quantity-modulation by output data from a computer, and so on, and then this electrostatic latent image is developed with toner by means of a developer to be rendered a visible image.

The paper conveying device B holds various constituent elements in series on the side plate 3 of the main body 2 of the device. The side plate 3, in turn, supported on the device main body 2 by a shaft 4 in a manner to be oscillatable at a certain definite angle in the counterclockwise direction. Although the side plate 3 is actually provided in pair, the one to the front side as viewed from the top surface of the drawing is omitted for clearly showing the arrangement of the constituent elements. Reference numerals 3*a* and 3*b* designate connecting plates for the side plates 3, 3.

The elements constituting the paper conveying device B include a guide plate 6 in an arcuate form in its cross-section, which guides fan-folded paper 5 (hereinafter simply referred to as "paper") having a series of engaging holes formed at both sides thereof and with perforations being made between adjacent sheets, and which is generally used in the field of the information processing; a paper end detector 7 and a paper splicing table 8 (hereinafter simply referred to as "splicing table"), both of which are in contact with the lower surface of the paper 5; first tractor 9 to forward the paper 5 in a substantially horizontal direction; a tensioner 10 to impart tension to the paper 5; a charger 11 which confronts to the photosensitive drum 1 of the printing mechanism A and transfers a visible image onto the paper 5; a pair of image transfer guide plates 12*a*, 12*b* with cause the paper 5 to contact to, and separate from, the surface of the photosensitive drum 1; second tractor 13 to forward the paper 5, which has been diverted its forwarding direction above the first tractor 9, in an upward, slant direction; and a buffer plate 14.

The paper end detector 7 is a photoelectric sensor of a reflected light type, and is used for stopping operations of the paper forwarding members such as the first and second tractors 9, 13 after detection of the last end of the paper 5 and when this last end arrives at a position past approximately half the splicing table 8.

The splicing table 8 is provided on the side plates 3, 3 in an oscillatable manner by a shaft 16 which is in such a relationship that a lower arm portion 15 of the splicing table intersects with the paper forwarding direction. Further, a cam 18 rotatably supported on the side plates 3, 3 by a shaft 17 is in contact with the side surface of the splicing table 8. The cam 18 has a flat portion 18*a* and an arcuate portion 18*b*. Further, between the side surface of the lower arm section 15 opposite to the cam 18 and the side plate 4, there is extended a tensioning coil spring 19 which is so energized that the paper splicing table 8 may be in constant contact with the cam 18.

The splicing table 8 has an opening 8*a* which is open below the lower surface of the paper 5 and is for setting therein the adhesive tape for splicing, and an internal cavity 8*b* beneath the opening 8*a* is connected with a hose 20 which is communicated to a vacuum pump (not shown).

The first tractor 9 has an endless belt 22 having a plurality of pins 21 to be engaged with the engaging holes in the paper 5, a driving roller 23, over which the belt 22 is extended, a driven roller 24, and an urging plate 25 for pressing the paper 5 toward the belt and which can be opened and closed. The abovementioned driving roller 23 is driven by a spline shaft 26. A reference numeral 27 designates a guide shaft for moving the first tractor 9 in conformity to the paper width. The first tractor 9 is used for forwarding the paper and the paper splicing operation to be mentioned later.

The second tractor 13 is of the same construction as the first tractor 9. In the drawing, the same parts are designated by the same reference numerals as those of the first tractor 9.

The spline shaft 26 of the first tractor 9 and the spline shaft 26 of the second tractor 13 are mutually connected by a timing belt and a gear (both not being shown), and the two tractors always have the same paper forwarding quantity. Incidentally, the first and second tractors 9, 13 are provided at positions corresponding to both sides of the paper 5, one at each side.

A brush 28 is provided in such a manner that is may contact the upper surface of the paper 5 before it proceeds into the first tractor 9. The brush 28 is for preventing the paper 5 from floating upward, and is fitted at the tip end of an arm 29. The rear end of the arm 29 is rotatably held by a shaft 30 on the device main body 2. A reference numeral 31 designates a pin constituting a stopper for the arm 29.

At the time of the paper forwarding, the arm 29 separates from the pin 31, and the brush 28 contacts the upper surface of the paper 5 by its own weight and the weight of the arm 29.

An image fixing section (not shown) is provided at the front part in the paper forwarding direction. The image fixing section has a heating roller and a pressure-applying roller, both of which rotate slidingly, and function to heat-fix the visible image which has been transferred onto the paper 5.

The buffer 14 has functions to absorb a difference in the paper forwarding quantity of the first and second tractors 9, 13 and the paper forwarding quantity of the heating roller, and to control the rotating speed of the heating roller.

In the following, explanations will be given as to the paper splicing operations.

Figure 2:
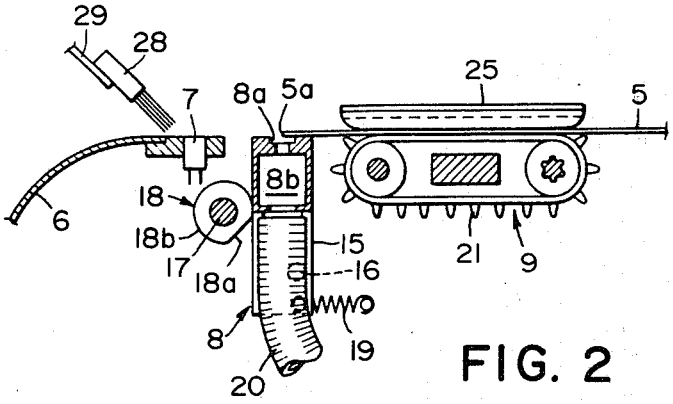
FIGS. 2 to 4, 6 and 7 are side elevational views showing steps of the paper splicing operation at the splicing section in the paper splicing device according to the present invention.

(a) When the last end 5*a* of the paper 5 passes through the paper end detector 7, the detector becomes actuated. As soon as the paper end reaches a position past approximately half way on the splicing table 8, the paper forwarding members of the first and second tractors 9, 13 and so on stop their operations (FIG. 2).

(b) When the shaft 17 of the cam 18 is rotated in the counter-clockwise direction, the flat portion 18*a* of the cam 18 faces the side wall of the splicing table 8, whereby the splicing table is oscillated to the left by the tensioning force of the spring 19 with the shaft 16 as its center of oscillation to thereby cause the opening 8*a* to escape from the paper end 5*a*.

Figure 3:
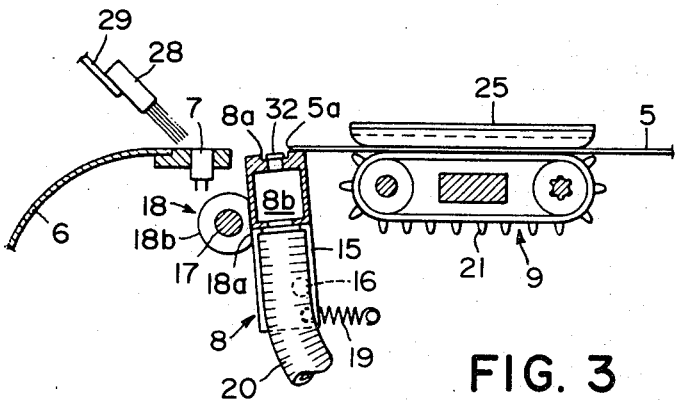

Then, a vacuum pump is actuated to suck air through the opening 8*a* to set the adhesive tape 32 in the opening with its adhesive surface being made upward. Thus, the adhesive tape 32 is stretched flat by the sucking force of the vacuum pump and set in the opening (FIG. 3).

Figure 4:
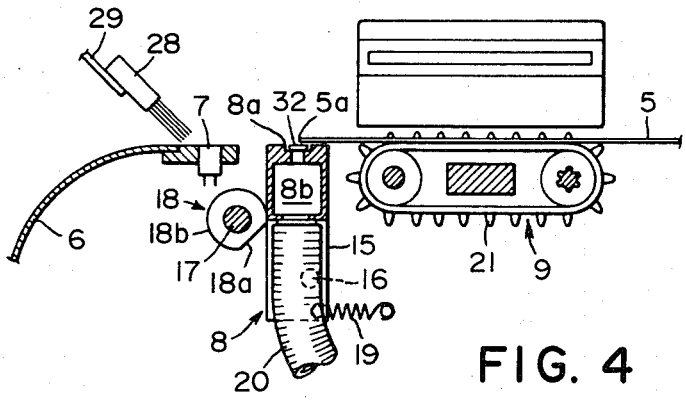

(c) By the clockwise rotation of the shaft 17 of the cam 18, the arcuate portion 18*b* of the cam 18 is caused to slide on the side wall of the splicing table to return the splicing table 8 to its original position by rightward oscillation thereof against the tensioning force of the spring 19, thereby bringing approximately half of the adhesive tape 32 and the paper end into an overlapped state. Thereafter, the urging plate 25 of the first tractor 9 is opened (FIG. 4).

Figure 5:
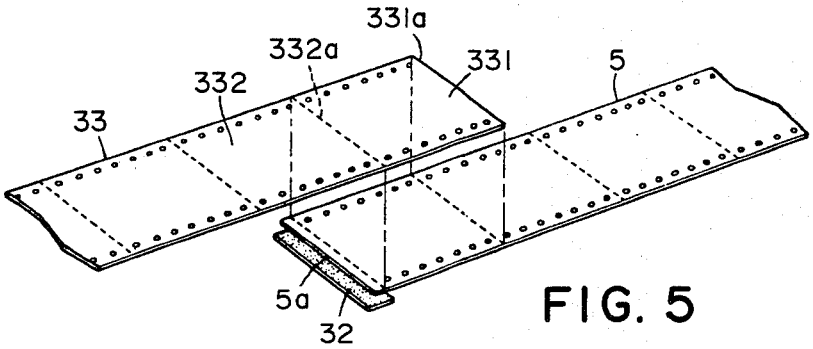
FIG. 5 is a perspective view showing the ends of both preceding and subsequent papers to be spliced.
Figure 6:
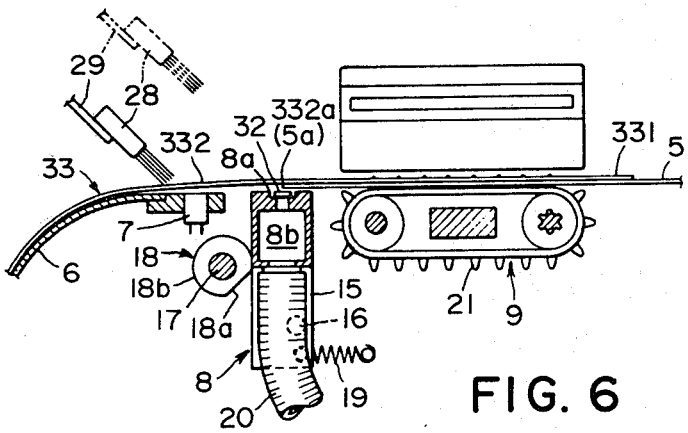

(d) By raising the arm 29, a new sheet of paper 33 is caused to pass under the brush 28. Then, as shown in FIG. 5, perforations 332*a* at the forward end of the second sheet 332 of the subsequent paper 33 is registered with the last end 5*a* of the preceding paper 5, and the engaging holes 331*a* of the first sheet 331 of the subsequent paper 33 are engaged with the pins 21 of the first tractor 9. Thereafter, the urging plate 25 is closed (FIG. 6).

Figure 7:
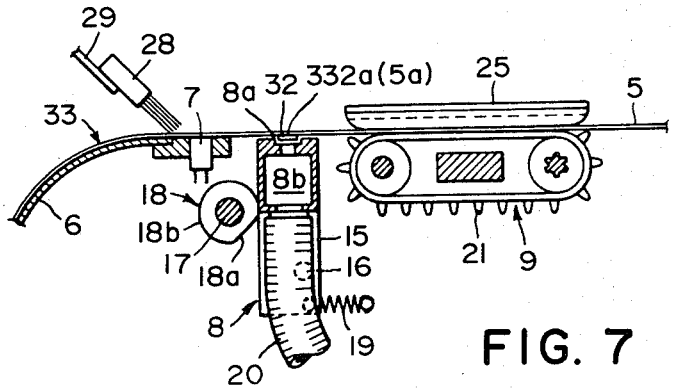

(e) The last end 5*a* of the preceding paper 5 and the second sheet 332 of the subsequent paper 33 are spliced by the adhesive tape 32. Then, the urging plate 25 is opened to permit the first sheet 331 of the fresh paper 33 to be torn apart along its perforations 332*a*, after which the urging plate 25 is again closed (FIG. 7).

(f) Operation of the vacuum pump is stopped, and the subsequent paper 33 is idle-forwarded. The quantity of the idle-forwarding is up to an intermediate position C in the breadthwise direction of the transfer charger 11 where the forward end of the subsequent paper 33 reaches.

After the abovementioned operations, the paper material can be forwarded in its unit of length. In case a newly supplied paper is to be set in the device without splicing, the side plates 3, 3 are rotated in the counter-clockwise direction at a certain definite angle with the shaft 4 as the center of rotation, thereby causing the paper to escape from the photosensitive drum 1, while the arm 29 of the brush 28 is caused to contact with the pin 31 so as to escape the brush 28 from paper conveying device B.

What I claim is:

1. A paper splicer, comprising:

tractor means for transporting paper, said tractor means having a plurality of movable pins for engagement with perforations formed at a lateral side of the paper;

a paper splicing table for splicing a terminal end portion of the paper with a new supply of paper, said paper splicing table being located upstream of said tractor means with respect to the direction of paper transport;

control means for stopping the terminal end portion of the paper on said paper splicing table, said control means being located upstream of said splicing table with respect to the direction of paper transport, such that the new supply of paper is registered, on said tractor means within the paper transport path, with the terminal end portion of the paper by engaging perforations of the new supply of paper with the pins of said tractor means; and splicing means, in said splicing table, adapted for receiving an adhesive splicing tape.

2. The paper splicer as set forth in claim 1, wherein said paper splicing table is oscillatable, only at the time of the paper splicing, in such a manner that it may approach to the neighborhood of the lower surface of the paper.

3. The paper splicer as set forth in claim 1, wherein said control means is provided adjacent said paper splicing table.

* * * * *